US005388702A

United States Patent [19]

Jones

[11] Patent Number: 5,388,702

[45] Date of Patent: Feb. 14, 1995

[54] PALLET JACKET

[75] Inventor: Samuel H. Jones, Spring, Tex.

[73] Assignee: WorldWide Container Services, Inc., Houston, Tex.

[21] Appl. No.: 93,393

[22] Filed: Jul. 19, 1993

[51] Int. Cl.[6] ..... B65D 19/00

[52] U.S. Cl. ..... 206/597; 206/83.5; 150/154; 296/100

[58] Field of Search ..... 206/83.5, 232, 497, 206/597; 150/154, 166; 410/97; 296/100; 52/3

[56] References Cited

U.S. PATENT DOCUMENTS

| | | | |
|---|---|---|---|
| 443,620 | 12/1890 | Orr | 206/83.5 |
| 1,068,066 | 7/1913 | Martin | 206/83.5 |
| 1,920,841 | 8/1933 | Clark | 206/83.5 |
| 2,455,237 | 11/1948 | Davis . | |
| 3,173,539 | 3/1965 | Looker . | |
| 3,185,197 | 5/1965 | Spiro et al. . | |
| 3,202,193 | 8/1965 | Ware . | |
| 3,312,181 | 4/1967 | Davidson | 206/597 |
| 3,466,774 | 9/1969 | Borresen | 206/232 |
| 3,548,904 | 12/1970 | Mackell . | |
| 3,614,154 | 10/1971 | Evans | 296/100 |
| 3,659,641 | 5/1972 | Marino . | |
| 4,538,385 | 9/1985 | Kandarian | 206/83.5 |
| 4,848,828 | 7/1989 | Hunt | 296/100 |
| 4,868,955 | 9/1989 | Magnant et al. . | |
| 4,968,085 | 11/1990 | Stann | 296/100 |
| 5,050,924 | 9/1991 | Hansen | 410/97 |

FOREIGN PATENT DOCUMENTS

| | | | |
|---|---|---|---|
| 4294745 | 10/1992 | Japan | 206/83.5 |
| 1387409 | 3/1975 | United Kingdom | 19/44 |

*Primary Examiner*—David T. Fidei
*Attorney, Agent, or Firm*—Arnold, White & Durkee

[57] ABSTRACT

A pallet jacket which is adapted to fit over and secure cargo to a base, such as an aircraft cargo pallet. The pallet jacket includes a cover having a central section and extending side flaps. The vertical lengths of the side flaps are preferably controllably adjustable. Separate securing straps are used to secure the cover over cargo and to a base. The securing straps are held proximate and in a sliding relation to the cover by strap keepers and lateral tension straps. The lateral tension straps are releasably connectable to form one or more continuous bands around portions of the cargo. In preferred embodiments, the cover 11 includes a windowed receptacle for retention and display of items upon the outside of the cover.

13 Claims, 3 Drawing Sheets

PALLET JACKET

BACKGROUND OF THE INVENTION

1. Field of the Invention

The present invention relates generally to a system for securing and protecting cargo. The system is particularly suited for use with palletized cargo for aircraft.

2. Description of the Related Art

A significant portion of cargo hauled by modern commercial aircraft must be arranged on a pallet and loaded into a cargo section within the aircraft. The palletized cargo is usually secured to the pallet using a number of nylon or rope straps which are affixed at their ends to portions of the pallet. If it is desired to protect the cargo from weather or other external elements, the cargo is typically shrink-wrapped in a plastic covering before the straps are emplaced around it.

The present strapping system is often unreliable and can lead to loss of or damage to the cargo. How well the cargo is secured to the pallets will depend greatly upon the experience and the strapping techniques used by the personnel employed to secure the cargo. A shortage of straps over portions of the cargo may allow these portions to shift during flight resulting in damage to the shrink wrap and/or the cargo within. The use of shrink-wrapping is also wasteful as the plastic material used to cover the cargo may only be used one time. Use of this method also requires significant time and manpower. An average of 30–45 minutes is needed to shrink-wrap and lash a cargo pallet using this system.

Alternative systems for securing cargo to pallets have been developed. Although these alternatives provide for weatherproofing and greater security against cargo being dislodged, they are ill equipped to deal with irregularly shaped cargo loads and are prone to systemic failure.

An arrangement is known, for instance, which employs a cargo lashing net made up of a plurality of elongated stringers arranged in net form and secured to each other at overlapping points by appropriate sewn thread. The net may be secured to the pallet by the attachment of hooks from the net to connecting plates which are flexibly secured to the pallet. Although it provides for more secure lashing, this design does not weatherproof or protect the cargo against external elements. Adjustment of the net to loads of non-uniform heights and widths is also difficult. In addition, if one or two of the elongated stringers is damaged or broken, the entire net may be compromised and require replacement.

Another system for securing cargo uses a blanket of strong canvas duck, nylon, or the like which is integral with cross strips of webbing stitched or otherwise suitably secured to the blanket. The ends of the strips are provided with hooks which are adapted to be secured to hold-down bolts or the like within a pallet. The strips of webbing are provided with takeup buckles to permit the cargo cover to be tightened down over cargo loads. The blanket may include flap extensions to fold down over the sides of the cargo. Slide fasteners or laced fastenings may be used for drawing the flap extensions closely together at the comers. Portions of the blanket may be folded to reduce it to half or quarter size. Unfortunately, this cargo blanket does not provide suitable security for irregularly shaped loads. The take-up straps are inherently limited in adjustability, and a broken or worn section of webbing may compromise the entire securing apparatus.

There is a continuing need for a more versatile and reusable cargo securing system, which is capable of protecting and securing irregularly shaped loads and which may be easily repaired in the event of failure of a securing strap.

SUMMARY OF THE INVENTION

The present invention features a pallet jacket which is adapted to fit over and secure items to a base, such as an aircraft pallet. The pallet jacket includes a cover made of substantially weather-resistant material sized and shaped to be placed over palletized items. The cover includes a central portion and extending side flaps. The side flaps may be reversibly connected to each other proximate their lateral edges so as to form a substantially weatherproof seam. Preferably the side flaps may be shortened to adapt the cover to properly cover cargo of lesser height.

The cover portion of the pallet jacket may be secured over the cargo using one or more separate securing straps. Preferably, the securing straps are positioned in a crossing pattern so as to run each securing strap along the central portion and a side flap. The securing straps are independently adjustable in length to a significant degree to accommodate loads of different or irregular heights and shapes. Adjustable lateral tensioning straps are affixed to the side flaps of the cover. The lateral tensioning straps are connectable proximate their ends to lateral tensioning straps on neighboring side flaps so as to form one or more continuous bands around portions of the cargo. The securing straps are held proximate to and adjacent the central portion of the cover by means of strap holders which are formed by a pair of flexible bands attached to the central portion and which permit a pair of crossing straps to be held in a sliding relation to the cover. Preferably, the securing straps are held proximate and in a sliding relation to the side flaps by the lateral tensioning straps.

In preferred embodiments, the cover includes a windowed receptacle suitable for retention and display of documents such as pallet or load identification placards, bills of lading, or other documents.

DETAILED DESCRIPTION OF THE PREFERRED EMBODIMENTS

The apparatus of the present invention provides a versatile and reusable system for quickly and readily protecting cargo items from weather and external elements and for securing them to a base such as an aircraft cargo pallet. The system provides significant time savings over use of the shrink-wrap method, requiring an average of only 15 minutes to prepare and secure a pallet. The apparatus is highly adjustable so that cargo of varying heights, and even irregular sizes, may be accommodated.

Figure 1:
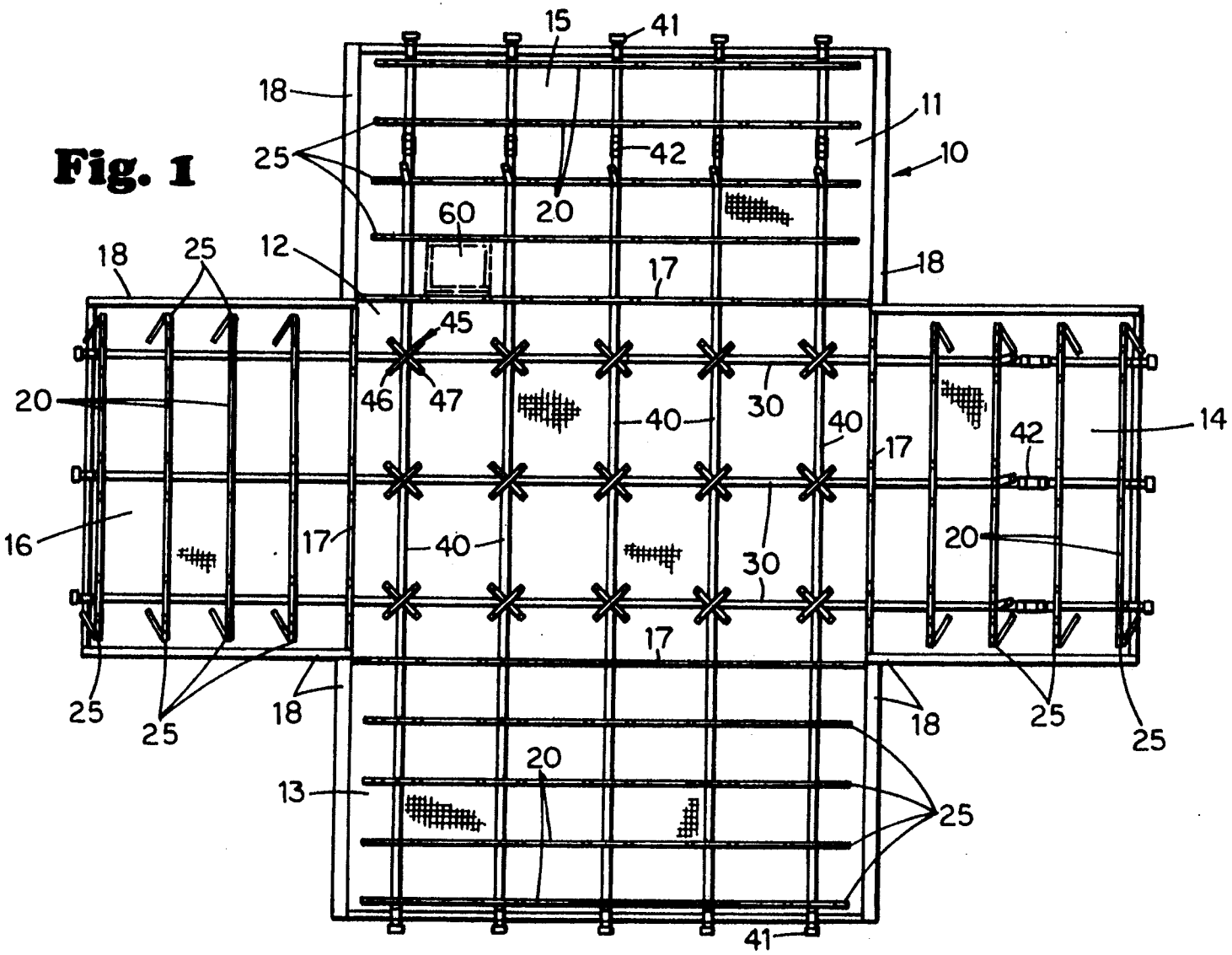
FIG. 1 shows an exemplary pallet jacket.
Figure 2:
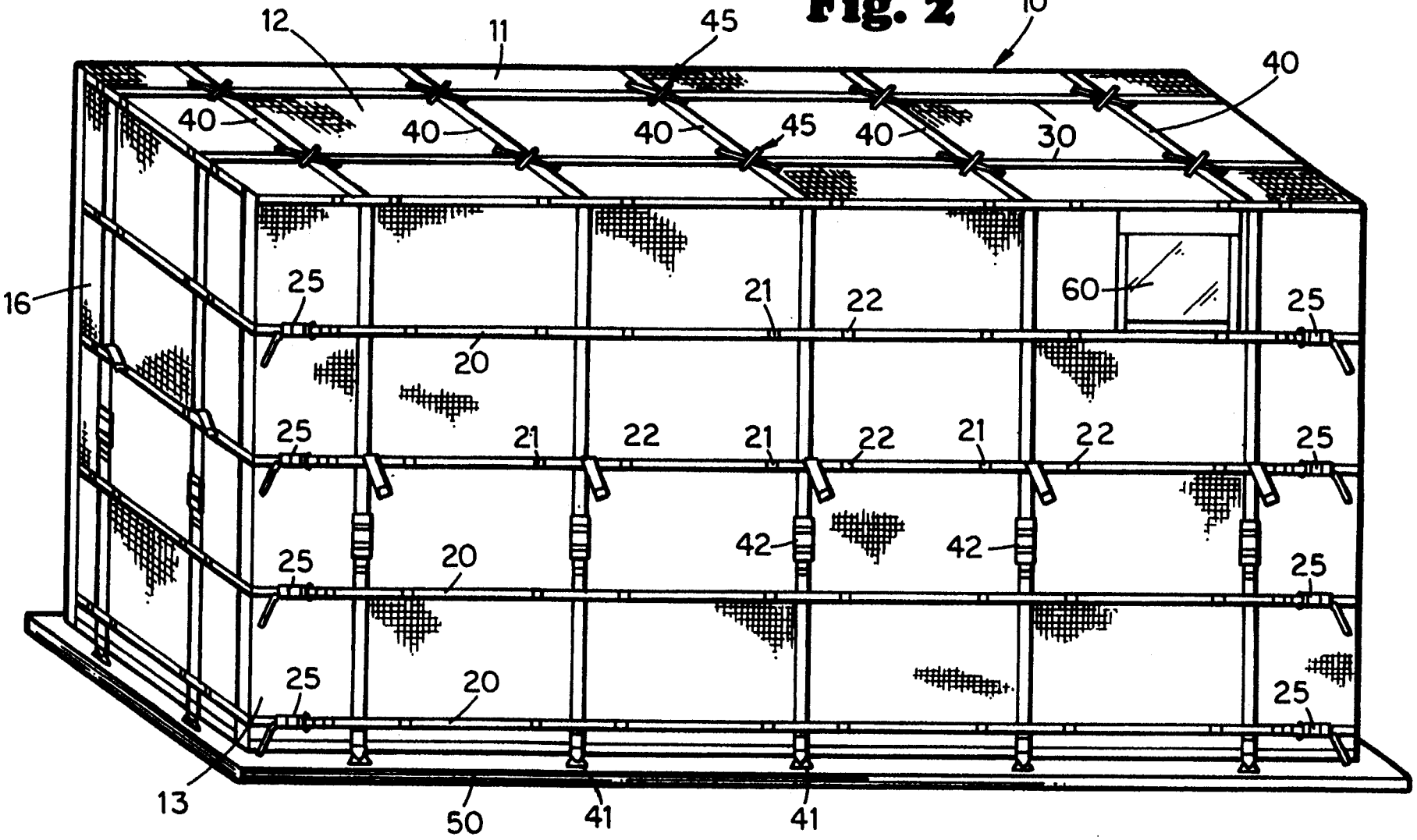
FIG. 2 shows the exemplary pallet jacket of FIG. 1 being used to secure cargo to a pallet.

A preferred embodiment is illustrated in FIG. 1 which shows a pallet jacket 10 fully expanded and prior to emplacement over cargo. The pallet jacket 10 includes a cover 11 which is adapted to enclose and cover cargo or some object which has been placed on a base, such as a cargo pallet. The cover is preferably made of a resilient and weather-resistant material such as nylon, heavy cotton duck, thick reinforced plastic sheeting, or other suitable material. It is noted that the cover may be made in any desired colors, as the colors of the pallet jacket may be useful for distinguishing the cargo load within from other loads or from loads being transported by other carriers. The cover 11 preferably comprises a central portion 12, which typically is positioned above and overlies the top part of the cargo, as may be seen in FIG. 2. At the perimeter of the central portion 12 are attached a plurality of side flaps 13, 14, 15 and 16 which extend away from the perimeter 17 to each terminate at a distal end. In use, the side flaps extend from the central portion 12 down toward the pallet or base and are positioned around the object on the base so as to form an enclosure. As illustrated in FIG. 1, the perimeter 17 of central portion 12 is rectangular. This embodiment of the invention is preferred as the rectangular shape of current cargo pallets most easily accommodates rectangular covers. However, it may instead have three, five or any number of sides, as dictated by the dimensions of the cargo being secured. The number of side flaps would then be related to the shape (i.e., the number of sides) of the central portions perimeter 17.

The opposing side edges 18 of each side flap are adapted to be releasably connectable to the edges 18 of the adjacent flap. This releasable connection is preferably accomplished with the use of Velcro ® strips but may be accomplished using zippers, snaps or other known fastening means to achieve a substantially weatherproof seam between the edges.

In a preferable embodiment, the side flaps 13, 14, 15 and 16 include a mechanism for controllably adjusting their in-use vertical length, i.e., the length of the flap as measured from the pallet upwards when the pallet jacket 10 is in use securing cargo to a pallet. This feature permits the pallet jacket to properly cover cargo of differing heights and prevents excess portions of the cover from bunching up near the pallet when reduced-height loads are covered. It preserves an orderly appearance for the loads and prevents excess portions of the cover from preventing a safety hazard during loading or transport. Also, the side edges may be shortened upwards from their lower points thereby preserving after the shortening process the integrity of logos, safety instructions, or other printed matter which are typically located in the upper portions of the side flaps.

Figure 4:
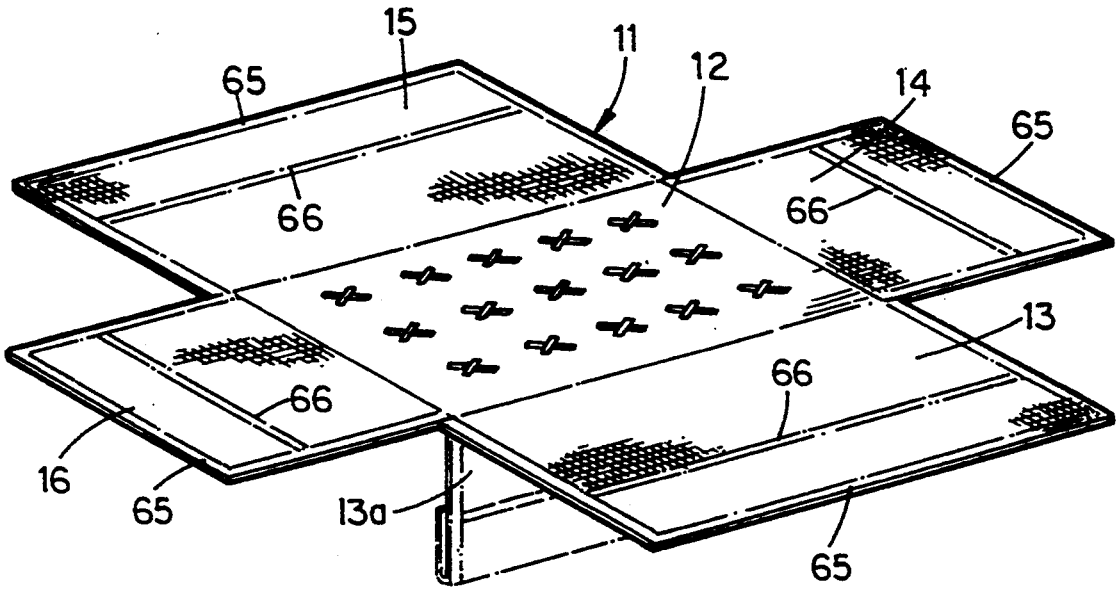
FIG. 4 shows portions of the exemplary pallet jacket of FIG. 1 including details for modifying the pallet jacket for reduced height cargo.

FIG. 4 illustrates a preferred embodiment of a means for controllably adjusting the inuse vertical lengths of the side flaps. An engaging fastener 65 is shown affixed upon a lower inside surface of exemplary side flaps 13, 14, 15 and 16. A complementary engageable fastener 66 is affixed above the fastener 65 on the inside surface of the side flaps 13, 14, 15 and 16. FIG. 4 illustrates an exemplary reduction in the in-use vertical length of side flap 13 at 13*a*. Upon engagement of the fasteners 65 and 66, the distal end of flap 13 will be folded within flap 13 and the in-use vertical length of exemplary side flap 13 will be uniformly reduced thereby. The placement of additional complementary engageable fasteners 66 at spaced points along the height of the side flap 13 enables the side flap 13 to be adjustable to a number of different lengths. Exemplary suitable fasteners 65, 66 include Velcro ® strips as well as rows of snap fasteners, clips, buttons and eyes, latches, and so forth.

Lateral security for cargo items is provided by a series of lateral tensioning straps 20. As may be seen in FIG. 2, the lateral tensioning straps 20 are releasably connectable at or near their ends to form one or more continuous bands around the length and breadth of portions of cargo being secured within. The lateral tensioning straps 20 are preferably connectable by means of buckles or fasteners 25 which provide for adjustment in the length of the straps 20 after fastening. One such suitable arrangement is commonly known as a flat hook and keeper with an associated cam buckle. Adjustment of the straps 20 tightens or loosens the continuous band which surrounds the cargo and is made up of the straps 20.

The lateral tensioning straps 20 are affixed at intervals along their length to the outside surface of their respective side flaps 13, 14, 15 and 16. It is preferred that the lateral tension straps 20 be affixed to the side flaps at a number of affixation points 21, 22 which are spaced apart from each other to a degree sufficient to permit insertion and passage of a separate strap and fastener between the lateral tensioning strap 20 and side flap and thereby define guides for such straps.

The cargo and cover 11 are lashed to a base such as pallet 50 by use of securing straps as shown in FIG. 1. It is preferred that securing straps 30 be provided to secure the cargo along its length, and that additional securing straps 40 be provided to secure the cargo along its breadth to the pallet. In use, the securing straps will extend from proximate the distal edge of a side flap, across that side flap and central portion 12, then crossing an opposing side flap to end proximate the opposing side flap's distal edge. The securing straps 30, 40 are adapted at each end to be releasably attached to the pallet 50 or other base. A common and efficient arrangement for accomplishing this is to provide a coupling member 41 proximate each end of a securing strap and which is adapted to be received by a complimentary coupling member within or proximate the pallet or other base. A suitable and popular connector of this sort is generally known as a double stud fitting. The securing straps 30, 40 are adjustable in length so that they may be loosened or tightened as necessary to properly secure the cargo to the pallet or other base. An adjustable buckle 42 provided along the length of a securing strap is one suggested arrangement for accomplishing this.

So that the pallet jacket may be operated and maintained as a unit, the securing straps are held proximate and in a sliding relation to the cover 11. The securing straps 30, 40 are also held proximate the cover's central portion 12 by a number of strap keepers 45. The strap keepers 45 preferably comprise a pair of bands 46, 47 which are attached by their ends to the central portion 12 of the cover. The bands 46, 47 are preferably attached at right angles to each other. In this position, the bands 46, 47 form pair of loops which permit the passage of crossing straps 30, 40 at right angles to each other and maintain each of these straps in a longitudinal sliding relation to the central portion 12. Preferably, the strap keepers will restrain excessive lateral movement of the strap upon the cover.

Figure 3:
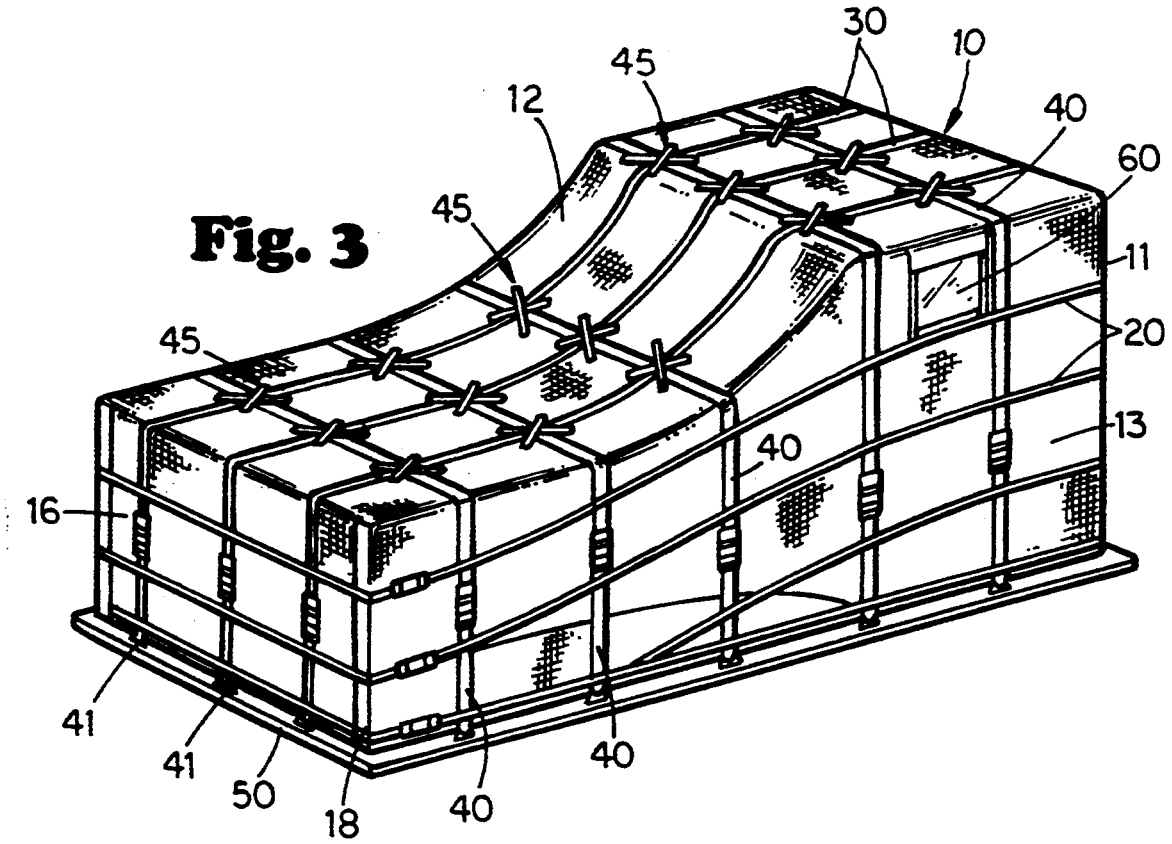
FIG. 3 shows the exemplary pallet jacket of FIG. 1 being used to secure irregularly shaped cargo to a pallet.

Because the securing straps 30, 40 are not fixedly attached, such as by stitching along their lengths, to the cover 11, they are highly adjustable. As a result, the pallet jacket 10 may be adapted to cover and secure cargo having a wide range of heights more readily than designs wherein such straps are fixedly attached to the cover. Also, because the straps 30, 40 are separate pieces from the cover 11, some of them may be tightened down toward the pallet 50 to a great extent while others left much looser to accommodate the needs of cargo having odd dimensions. FIG. 3 illustrates use of an exemplary pallet jacket to secure one such irregularly shaped load. Because the securing straps 30, 40 are not fixedly connected to the cover 11, the cover 11 will not be skewed or strained significantly when securing irregularly shaped cargo.

In preferred embodiments, the cover 11 includes a receptacle 60 such as a substantially weather-proof pouch on its outside surface. The receptacle 60 is preferably placed upon one of the side flaps so that it may be easily seen when the pallet jacket is emplaced over cargo. It is also preferred that the receptacle 60 include a clear plastic window in its structure to permit viewing of the contents of the receptacle from without. The receptacle 60 may be sized as needed to enable the retention and display of items within such as placards for identification of particular pallets and loads of cargo, or for documents such as bills of lading.

I claim:

1. Apparatus for securing cargo to a base comprising:

a) a cover having an inside surface and an outside surface, made of substantially weather-resistant material and adapted to cover the cargo on the base of a pallet, said cover including a central portion adapted to overlie the top portions of the cargo, said central portion having a perimeter, and a plurality of side flaps attached to the perimeter of the central portion so as to enclose side portions of the cargo, each of said flaps having edges releasably connectable to edges of adjacent side flaps to form a substantially weatherproof seam;

b) at least one lateral tension strap affixed to a portion of the cover, each said lateral tension strap having two ends, being adjustable in length and adapted to surround a portion of the cargo;

c) one or more strap keepers affixed to the cover and adapted to permit a pair of crossing straps to be held proximate the cover and in sliding relation thereto; and d) at least one securing strap adapted at each end to be secured to the base, each said securing strap further adapted to be held proximate the cover by at least one said lateral tension strap and at least one said strap keeper in sliding relation to said cover.

2. The apparatus of claim 1 wherein each said lateral tension strap is affixed along portions of its length to one said side flap.

3. The apparatus of claim 2 wherein each said lateral tension strap is connectable at one or both of its ends to another lateral tension strap.

4. The apparatus of claim 1 wherein the securing strap is held proximate .and in a sliding relation to a side flap by said lateral tension strap.

5. The apparatus of claim 1 wherein at least one side flap includes a releasable connector upon its inside surface, said releasable connector adapted to shorten a portion of the side flap when said connector is connected.

6. A jacket for enclosing an object on a base, said jacket comprising:

a) a central jacket section adapted to be positioned above an object on a base, said section having a plurality of sides;

b) a separate flap extending from each said side to define a distal end of the flap and opposing side edges of the flap, each said side edge adapted to be releasably connected to the side edge of an adjacent flap when the flaps are positioned around said object so as to form an enclosure for the object;

c) a separate set of laterally spaced, longitudinally adjustable, securing straps arranged along each said flap, the securing straps in each set extending from proximate the distal edge of its respective flap and across said central jacket section;

d) strap keepers attached to the central jacket section and the flaps and spaced along each securing strap to restrain lateral movement of the strap but to enable the strap to move lengthwise relative to the central jacket and its respective flap;

e) a separate set of lateral tensioning straps extending across each flap, each said tensioning strap having two ends and attached between its ends to its respective flap;

f) a set of first coupling members, each said first coupling member being of a type to couple the end of a tensioning strap of any given said flap in tension to the end of a tensioning strip of a flap adjoining the given flap when in position enclosing said object; and g) a set of second coupling members of a character to couple ends of the securing straps to the base.

7. The jacket of claim 6, wherein each securing strap extends from the distal edge of any given flap across the central jacket section and to the distal edge of the flap opposite the given flap.

8. The jacket of claim 7, wherein the strap keepers attached to the central jacket section are located at positions where the securing straps of one pair of opposite flaps cross the securing straps of a second pair of opposite flaps.

9. The jacket of claim 8, wherein the central jacket section has four sides and there are four flaps.

10. The jacket of claim 9, wherein the strap keepers attached to the central jacket section comprise pairs of crossing strips attached at each end to the central jacket portion to define pairs of loops through which the securing straps are capable of moving longitudinally relative to the loops.

11. The jacket of claim 10, wherein the distal end of each flap may be folded within the flap to adjust the length of the flap.

12. A jacket for covering cargo on an air cargo pallet, which comprises:

a) a rectangular central section having four depending flaps adapted to enclose cargo on a pallet, each flap having a distal end and two opposing side edges releasably connectable to side edges of adjoining said flaps;

b) a first set of laterally spaced, longitudinally adjustable, securing straps extending from the distal end of one of a first pair of opposing said flaps across the central section to the distal end of the second of said first pair of flaps;

c) a second set of laterally spaced, longitudinally adjustable, securing straps extending from the distal end of one of the second pair of opposing said flaps across the central section and the first set of said securing straps to the distal end of the second of said second pair of flaps;

d) a separate strap keeper attached to the central section at each crossing of said first and second sets of securing straps to restrain lateral movement of said securing straps but enabling longitudinal movement of the securing straps relative to one another and said central section;

e) a separate set of lateral tensioning straps extending across each said flap and attached at intervals along their length to their respective flaps to define guides for the passage and movement of said securing straps along said flaps;

f) sets of first coupling members attached to the ends of the tensioning straps and of a character to enable each end of any given tensioning strap to be releasably connected to an end of a tensioning strap on an adjoining strap; and g) second coupling members of a character to releasably connect each end of each said securing strap to the cargo pallet.

13. The apparatus of claim 1 wherein said base is a cargo pallet and the cover is adapted to cover the cargo on the cargo pallet.

* * * * *